US009632447B2

(12) United States Patent
Tatsumoto et al.

(10) Patent No.: US 9,632,447 B2
(45) Date of Patent: Apr. 25, 2017

(54) IMAGE FORMING APPARATUS HAVING VARIABLE DEVELOPING ROLLER VOLTAGE CHANGE

(71) Applicant: Konica Minolta, Inc., Chiyoda-ku, Tokyo (JP)

(72) Inventors: Yuhei Tatsumoto, Toyokawa (JP); Katsuhide Sakai, Toyokawa (JP); Yasuhiro Koide, Toyohashi (JP); Yuta Tachibana, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/041,613

(22) Filed: Feb. 11, 2016

(65) Prior Publication Data

US 2016/0238962 A1 Aug. 18, 2016

(30) Foreign Application Priority Data

Feb. 16, 2015 (JP) ..... 2015-027702

(51) Int. Cl.
*G03G 15/02* (2006.01)
*G03G 15/06* (2006.01)

(52) U.S. Cl.
CPC ..... *G03G 15/0266* (2013.01); *G03G 15/065* (2013.01)

(58) Field of Classification Search
CPC ..... G03G 2217/091
See application file for complete search history.

(56) References Cited

U.S. PATENT DOCUMENTS

2010/0074641 A1* 3/2010 Takenaka ..... G03G 15/161 399/66
2013/0028621 A1* 1/2013 Furukawa ..... G03G 15/06 399/55
2013/0108295 A1* 5/2013 Kanehara ..... G03G 15/0291 399/50

FOREIGN PATENT DOCUMENTS

JP 2010-175613 A 8/2010
JP 2012-113040 A 6/2012

* cited by examiner

*Primary Examiner* — Clayton E Laballe
*Assistant Examiner* — Victor Verbitsky
(74) *Attorney, Agent, or Firm* — Buchanan Ingersoll & Rooney PC

(57) ABSTRACT

An image forming apparatus includes: a photosensitive member rotated in a predetermined direction; a charging unit configured to charge a circumferential surface of the photosensitive member; a developing unit carrying a developer including toner and carriers, and including a developer bearing member configured to apply toner charged in a first polarity to the circumferential surface of the photosensitive member; a first voltage applying unit configured to apply a first voltage of the first polarity to the charging unit; a second voltage applying unit configured to apply a second voltage of the first polarity to the developer bearing member; a first voltage detecting unit configured to detect the first voltage; a second voltage detecting unit configured to detect the second voltage; and a controller, wherein the controller determines whether or not to make a second rate lower than a first rate according to the second voltage at a first timing.

6 Claims, 9 Drawing Sheets

IMAGE FORMING APPARATUS HAVING VARIABLE DEVELOPING ROLLER VOLTAGE CHANGE

The entire disclosure of Japanese Patent Application No. 2015-027702 filed on Feb. 16, 2015 including description, claims, drawings, and abstract are incorporated herein by reference in its entirety.

BACKGROUND OF THE INVENTION

Field of the Invention

The present invention relates to an image forming apparatus, and in particular to an image forming apparatus for forming a toner image on a printing medium.

Description of the Related Art

In a typical image forming apparatus, a voltage of −800 V is applied to a developing roller and a voltage of −1000 V is applied to a photosensitive drum, for example. The photosensitive drum is also irradiated with a beam by an optical scanner. The voltage of a part, irradiated with the beam, of the photosensitive drum becomes −100 V, for example. As a result, negatively charged toner does not move from the developing roller to a part, which is not irradiated with the beam, of the photosensitive drum, but moves from the developing roller to the part, irradiated with the beam, of the photosensitive drum. A toner image is developed in this manner.

In a typical image forming apparatus, adhesion of carriers to a photosensitive drum is prevented by an operation described below. FIG. 8 is a diagram illustrating a photosensitive drum 500, a charger 502, and a developing roller 504. FIG. 9 is a graph showing changes in voltage applied to the photosensitive drum 500 and voltage applied to the developing roller 504 while the voltages are raised. FIG. 10 is a graph showing a change in voltage at a part of the photosensitive drum 500 that the developing roller 504 faces and a change in voltage of the developing roller 504. Note that the change in voltage at the part of the photosensitive drum 500 that the developing roller 504 faces in FIG. 10 is obtained by delaying the change in the voltage applied to the photosensitive drum 500 of FIG. 9 by a time required for the photosensitive drum 500 to rotate from the charger 502 to the developing roller 504. In FIGS. 9 and 10, the vertical axis represents voltage and the horizontal axis represents time.

In the image forming apparatus, the absolute value of a voltage output by the charger 500 increases at a predetermined rate, and becomes constant after reaching 1000 V (−1000 V) at time T101. The absolute value of the voltage applied to the developing roller 504 also increases at a predetermined rate, and becomes constant after reaching 800 V (−800 V) at time T102. It is thus preferable that the voltage applied to the developing roller 504 reach −800 V at a timing when a part, to which a voltage of −1000 V is applied, of the photosensitive drum 500 reaches the developing roller 504.

Such a timing, however, varies. The voltage of the developing roller 504 may therefore reach −800 V before or after the part, to which a voltage of −1000 V is applied, of the photosensitive drum 500 reaches the developing roller 504. In particular, when the reaching of the voltage of the developing roller 504 is delayed, the difference between the voltage of the photosensitive drum 500 and the voltage of the developing roller 504 becomes large, which makes the electric field from the photosensitive drum 500 toward the developing roller 504 stronger. Positively charged carriers thus receive a greater force in a direction from the developing roller 504 toward the photosensitive drum 500. As a result, the force that the carriers receive by the electric field becomes greater than the force by which the carriers are attracted to the developing roller 504 caused by a magnetic force. The carriers thus move from the developing roller 504 to the photosensitive drum 500. Adhesion of carriers to the photosensitive drum 500 may cause damage to the image forming apparatus.

In view of the above, in the image forming apparatus, the voltage of the developing roller 504 is made to reach −800 V at time T102 that is a predetermined time T100 before time T103 at which the part, where the application of voltage is started, of the photosensitive drum 500 reaches the developing roller 504 as shown in FIG. 10. This prevents or reduces adhesion of carriers to the photosensitive drum 500.

A typical image forming apparatus, however, is disadvantageous in wasting toner. More specifically, as shown by a hatched region in FIG. 10, when the timing at which the voltage of the developing roller 504 reaches −800 V is made earlier, there is a period during which the voltage of the developing roller 504 is lower than that of the photosensitive drum 500. During this period, negatively charged toner moves from the developing roller 504 to the photosensitive drum 500.

Here, if the predetermined time T100 is shorter, wasteful consumption of toner will be reduced. The predetermined time T100, however, is a time determined in view of the variations in the rises of the voltage applied to the photosensitive drum 500 and the voltage applied to the developing roller 504, and the like. It is therefore difficult to shorten the predetermined time T100 to 0.

An image forming apparatus disclosed in JP 2012-113040 A, for example, is known as an invention relating to image forming apparatuses. In the image forming apparatus, the rise timing of a developing bias is controlled, so that wasteful consumption of developer will be reduced.

SUMMARY OF THE INVENTION

An object of the present invention is therefore to provide a novel image forming apparatus capable of reducing wasteful consumption of toner while the voltage of a developing roller and the voltage of a charger are raised.

To achieve the abovementioned object, according to an aspect, an image forming apparatus reflecting one aspect of the present invention comprises: a photosensitive member rotated in a predetermined direction; a charging unit configured to charge a circumferential surface of the photosensitive member; a developing unit carrying a developer including toner and carriers, and including a developer bearing member configured to apply toner charged in a first polarity to the circumferential surface of the photosensitive member; a first voltage applying unit configured to apply a first voltage of the first polarity to the charging unit; a second voltage applying unit configured to apply a second voltage of the first polarity to the developer bearing member; a first voltage detecting unit configured to detect the first voltage; a second voltage detecting unit configured to detect the second voltage; and a controller, wherein the controller determines whether or not to make a second rate lower than a first rate according to the second voltage at a first timing when the first voltage reaches a first predetermined voltage after causing the first voltage applying unit and the second voltage applying unit to start application of the first voltage and the second voltage, respectively, the second rate being a rate at which an absolute value of the second voltage increases per unit time after the first timing, the first rate being a rate at which an absolute value of the second voltage increases per unit time before the first timing.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an image forming apparatus according to an embodiment of the present invention will be described with reference to the drawings. However, the scope of the invention is not limited to the illustrated examples.

Configuration of Image Forming Apparatus

Figure 1:
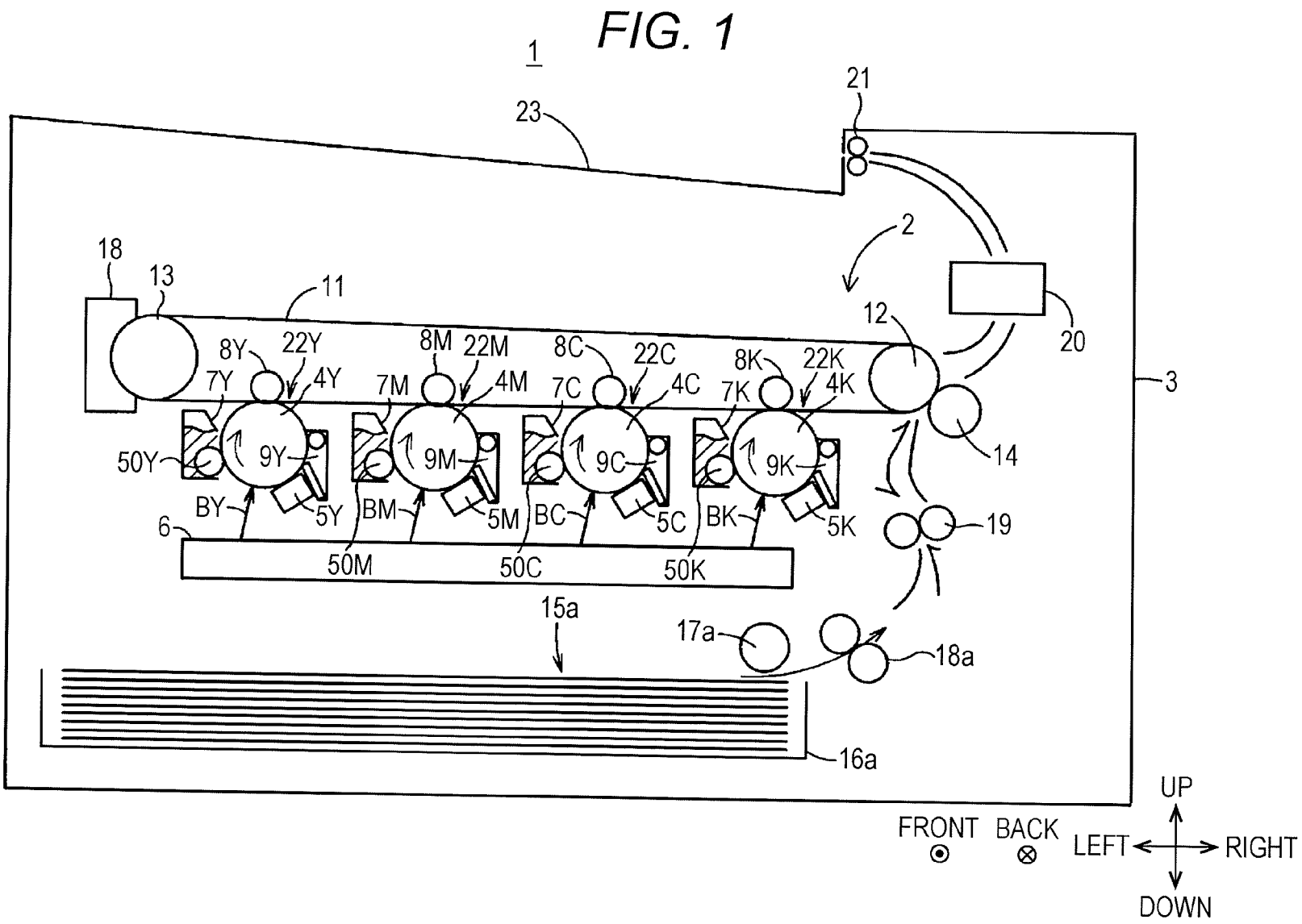
FIG. 1 is a diagram illustrating an overall configuration of an image forming apparatus.
Figure 2:
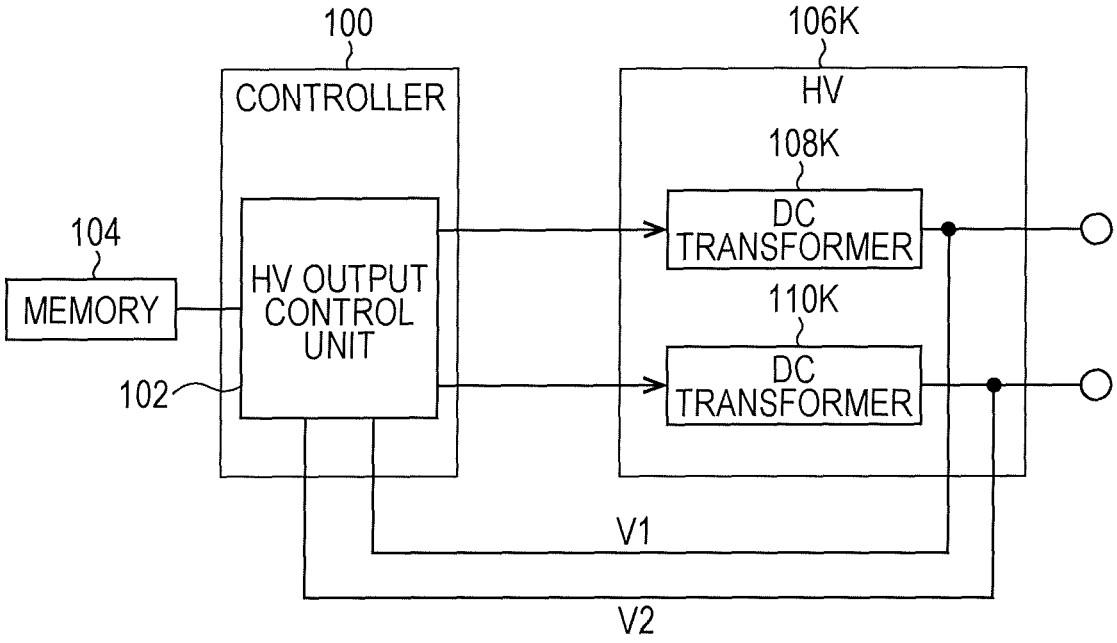
FIG. 2 is a block diagram of a configuration relating to voltage application to a photosensitive drum and a charger of the image forming apparatus.

Hereinafter, the image forming apparatus according to the embodiment of the present invention will be described with reference to the drawings. FIG. 1 is a diagram illustrating an overall configuration of an image forming apparatus 1. In FIG. 1, the left-right direction on the drawing sheet will be referred to simply as the left-right direction, the front-back direction on the drawing sheet will be referred to simply as the front-back direction, and the up-down direction will be referred to simply as the up-down direction. FIG. 2 is a block diagram of a configuration relating to voltage application to a photosensitive drum 4K and a charger 5K of the image forming apparatus 1. The up-down direction corresponds to the vertical direction, and the front-back direction corresponds to the main scanning direction. The front-back direction, the up-down direction, and the left-right direction are perpendicular to one another. These directions are only an example.

The image forming apparatus 1 is an electrophotographic color printer configured to combine images of four colors (Y: yellow, M: magenta, C: cyan, K: black) in a so-called tandem system. The image forming apparatus 1 has a function of forming an image on a sheet (printing medium) on the basis of image data read by a scanner, and includes a printing unit 2, a body 3, a sheet cassette 15*a*, a pair of conveyance rollers 18*a*, a pair of timing rollers 19, a fixing device 20, a pair of discharge rollers 21, a discharge tray 23, a controller 100, a memory 104, and a high-voltage power supply 106K as illustrated in FIGS. 1 and 2. Although the image forming apparatus 1 also includes high-voltage power supplies 106Y, 106M, and 106C, the high-voltage power supplies 106Y, 106M, and 106C are not illustrated in FIG. 2.

The controller 100 controls the operation of the image forming apparatus 1, and is constituted by a CPU, for example. The memory 104 stores predetermined information.

The body 3 is a housing of the image forming apparatus 1, and contains the printing unit 2, the sheet cassette 15*a*, the pair of conveyance rollers 18*a*, the pair of timing rollers 19, the fixing device 20, the pair of discharge rollers 21, the controller 100, the memory 104, and the high-voltage power supply 106K.

The sheet cassette 15*a* can contain sheets, and feeds one sheet at a time. The sheet cassette 15*a*, in general, includes a sheet tray 16*a* and a feeding roller 17*a*. Multiple unprinted sheets are placed in a stack on the sheet tray 16*a*. The feeding roller 17*a* takes one sheet at a time from the sheets placed on the sheet tray 16*a*.

The pair of conveyance rollers 18*a* is provided on the right of the sheet cassette 15*a*, and conveys the sheet taken by the feeding roller 17*a* to the pair of timing rollers 19. The pair of timing rollers 19 conveys the sheet while adjusting the timing so that a toner image will be secondarily transferred to the sheet at the printing unit 2.

The printing unit 2 forms a toner image therein and transfers the toner image to a sheet conveyed by the pair of timing rollers 19. The printing unit 2 includes an optical scanner 6, transfer units 8Y, 8M, 8C, and 8K, an intermediate transfer belt 11, a driving roller 12, a driven roller 13, a secondary transfer roller 14, a cleaning device 18, and image forming units 22Y, 22M, 22C, and 22K. The image forming units 22Y, 22M, 22C, and 22K include photosensitive drums 4Y, 4M, 4C, and 4K, chargers 5Y, 5M, 5C, and 5K, developing devices 7Y, 7M, 7C, and 7K, and cleaners 9Y, 9M, 9C, and 9K, respectively.

The photosensitive drums 4Y, 4M, 4C, and 4K are provided in the body 3, and each have a cylindrical shape extending in the front-back direction. The photosensitive drums 4Y, 4M, 4C, and 4K are rotated in the clockwise direction in plan view as viewed from the front.

The chargers 5Y, 5M, 5C, and 5K apply a negative charging voltage V1 to circumferential surfaces of the photosensitive drums 4Y, 4M, 4C, and 4K to charge the circumferential surfaces of the photosensitive drums 4Y, 4M, 4C, and 4K, respectively. Thus, the negative charging voltage V1 applied to the chargers 5Y, 5M, 5C, and 5K by the high-voltage power supplies 106Y, 106M, 106C, and 106K, respectively, which will be described later. The charging voltage V1 when electrostatic latent images formed on the circumferential surfaces of the photosensitive drums 4Y, 4M, 4C, and 4K are developed is −1000 V, for example.

The optical scanner 6 scans the circumferential surfaces of the photosensitive drums 4Y, 4M, 4C, and 4K with beams BY, BM, BC, and BK under the control of the controller 100. The voltage at parts, irradiated with the beams BY, BM, BC, and BK, of the circumferential surfaces of the photosensitive drums 4Y, 4M, 4C, and 4K is −100 V, for example. As a result, electrostatic latent images are formed on the circumferential surfaces of the photosensitive drums 4Y, 4M, 4C, and 4K.

The developing devices 7Y, 7M, 7C, and 7K are provided in the body 3, and function as developing units for developing the electrostatic latent images formed on the photosensitive drums 4Y, 4M, 4C, and 4K, respectively, with toner. The developing devices 7Y, 7M, 7C, and 7K include developing rollers 50Y, 50M, 50C, and 50K, respectively. Hereinafter, the developing device 7K will be described as an example of the developing devices 7Y, 7M, 7C, and 7K.

The developing device 7K contains a developer including toner and carriers. The developing device 7K carries the developer while agitating the developer with a carrying screw, which is not illustrated. As a result, the toner is negatively charged while the carriers are positively charged. The developing roller 50K has a cylindrical shape extending in the front-back direction, and is a developer bearing member that bears a developer including toner and carriers on a circumferential surface thereof. A negative developing voltage V2 is applied to the developing roller 50K by the high-voltage power supply 106K, which will be described later. The absolute value of the developing voltage V2 when electrostatic latent images formed on the circumferential surfaces of the photosensitive drums 4Y, 4M, 4C, and 4K is smaller than that of the charging voltage V1. The developing voltage V2 when electrostatic latent images formed on the circumferential surfaces of the photosensitive drums 4Y, 4M, 4C, and 4K are developed is −800 V, for example. The developing roller 50K faces the photosensitive drum 4K, and applies the negatively charged toner to the circumferential surface of the photosensitive drum 4K by means of a potential difference between the developing roller 50K and the photosensitive drum 4K to develop an electrostatic latent image into a toner image.

More specifically, the voltage of a part, which is not irradiated with the beam BK, of the circumferential surface of the photosensitive drum 4K is −1000 V, which is equal to the charging voltage V1. In addition, the developing voltage V2 of the developing roller 50K is −800 V. The developing voltage V2 of the developing roller 50K is thus higher than that at the part, which is not irradiated with the beam BK, of the circumferential surface of the photosensitive drum 4K. The negatively charged toner therefore does not move from the developing roller 50K to the part, which is not irradiated with the beam BK, of the circumferential surface of the photosensitive drum 4K. The positively charged carriers receive a force from an electric field in a direction from the developing roller 50K toward the part, which is not irradiated with the beam BK, of the circumferential surface of the photosensitive drum 4K. Since, however, the carriers are attracted to the developing roller 50K by the magnetic force of a magnet disposed in the developing roller 50K, the carriers do not move from the developing roller 50K to the part, which is not irradiated with the beam BK, of the circumferential surface of the photosensitive drum 4K.

In contrast, the voltage of the part, irradiated with the beam BK, of the circumferential surface of the photosensitive drum 4K is −100 V, which is equal to the charging voltage V1. The developing voltage V2 of the developing roller 50K is thus lower than the voltage at the part, irradiated with the beam BK, of the circumferential surface of the photosensitive drum 4K. The negatively charged toner therefore moves from the developing roller 50K to the part, irradiated with the beam BK, of the circumferential surface of the photosensitive drum 4K. Electrostatic latent images are developed in this manner.

The intermediate transfer belt 11 is stretched over the driving roller 12 and the driven roller 13. Toner images developed on the photosensitive drums 4Y, 4M, 4C, and 4K are primarily transferred to the intermediate transfer belt 11. The transfer units 8Y, 8M, 8C, and 8K are arranged to face the inner circumferential surface of the intermediate transfer belt 11, and has the role of primarily transferring toner images formed on the photosensitive drums 4Y, 4M, 4C, and 4K to the intermediate transfer belt 11. The cleaners 9Y, 9M, 9C, and 9K collect toner remaining on the circumferential surfaces of the photosensitive drums 4Y, 4M, 4C, and 4K after the primary transfer. The driving roller 12 is rotated by an intermediate transfer belt driving unit (not illustrated in FIG. 1) to drive the intermediate transfer belt 11 in the counterclockwise direction in plan view as viewed from the front. As a result, the intermediate transfer belt 11 conveys toner images to the secondary transfer roller 14.

The secondary transfer roller 14 faces the intermediate transfer belt 11 and has a drum shape. Application of transfer voltage to the secondary transfer roller 14 causes the secondary transfer roller 14 to secondarily transfer the toner images carried by the intermediate transfer belt 11 onto a sheet passing between the secondary transfer roller 14 and the intermediate transfer belt 11. The cleaning device 18 removes the toner remaining on the intermediate transfer belt 11 after the secondary transfer of the toner images onto the sheet.

The sheet to which the toner images have been secondarily transferred is conveyed to the fixing device 20. The fixing device 20 performs a heat treatment and a pressure treatment on the sheet to fix the toner images onto the sheet.

The pair of discharge rollers 21 discharges sheets having passed through the fixing device 20 onto the discharge tray 23. Printed sheets are stacked on the discharge tray 23.

Next, a configuration relating to voltage application to the chargers 5Y, 5M, 5C, and 5K and the developing rollers 50Y, 50M, 50C, and 50K of the image forming apparatus 1 will be described with reference to FIG. 2. In the following, the charger 5K and the developing roller 50K will be described as examples.

The high-voltage power supply 106K includes a DC transformer 108K and a DC transformer 110K. The DC transformer 108K applies charging voltage V1 to the charger 5K. The DC transformer 110K applies developing voltage V2 to the developing roller 50K.

The controller 100 includes a HV output control unit 102. The HV output control unit 102 detects the charging voltage V1, and performs feedback control of the rise of the charging voltage V1 by PWM control. The HV output control unit 102 further detects the developing voltage V2, and performs feedback control of the rise of the developing voltage V2 by PWM control.

Operation of Image Forming Apparatus

Hereinafter, the operation of the image forming apparatus 1 will be described in more detail. While raising the charging voltage V1 and the developing voltage V2, the image forming apparatus 1 performs feedback control of the rise of the developing voltage V2 so as to prevent wasteful consumption of toner. In the following, the charging voltage V1 of the charger 5K and the developing voltage V2 of the developing roller 50K will be described as examples. The operation described below is carried out at the first printing operation of a day after a night during which the image forming apparatus 1 stopped operating, for example.

Figure 3:
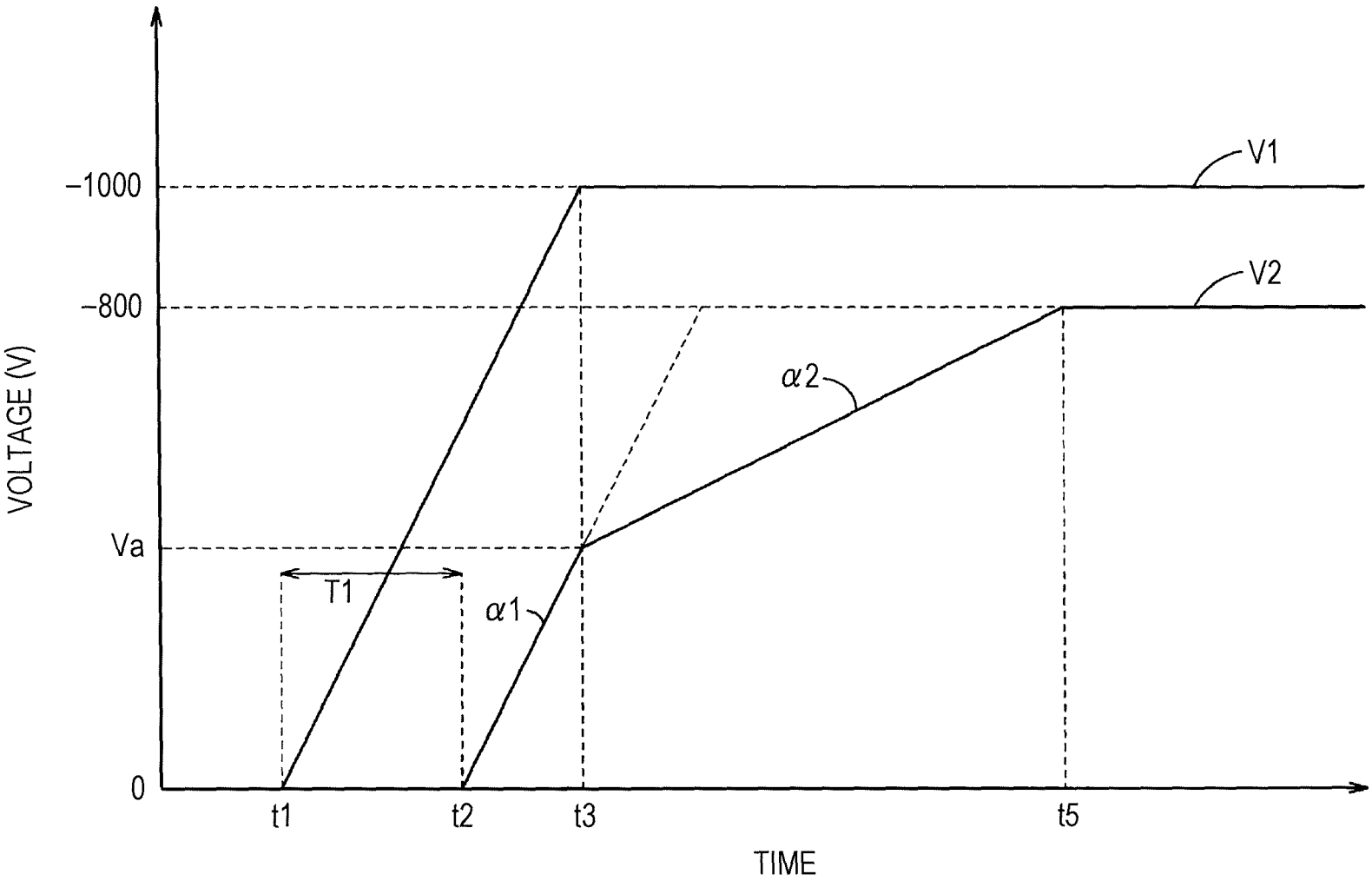
FIG. 3 is a graph showing changes in charging voltage applied to the photosensitive drum and developing voltage applied to a developing roller while the voltages are raised.
Figure 4:
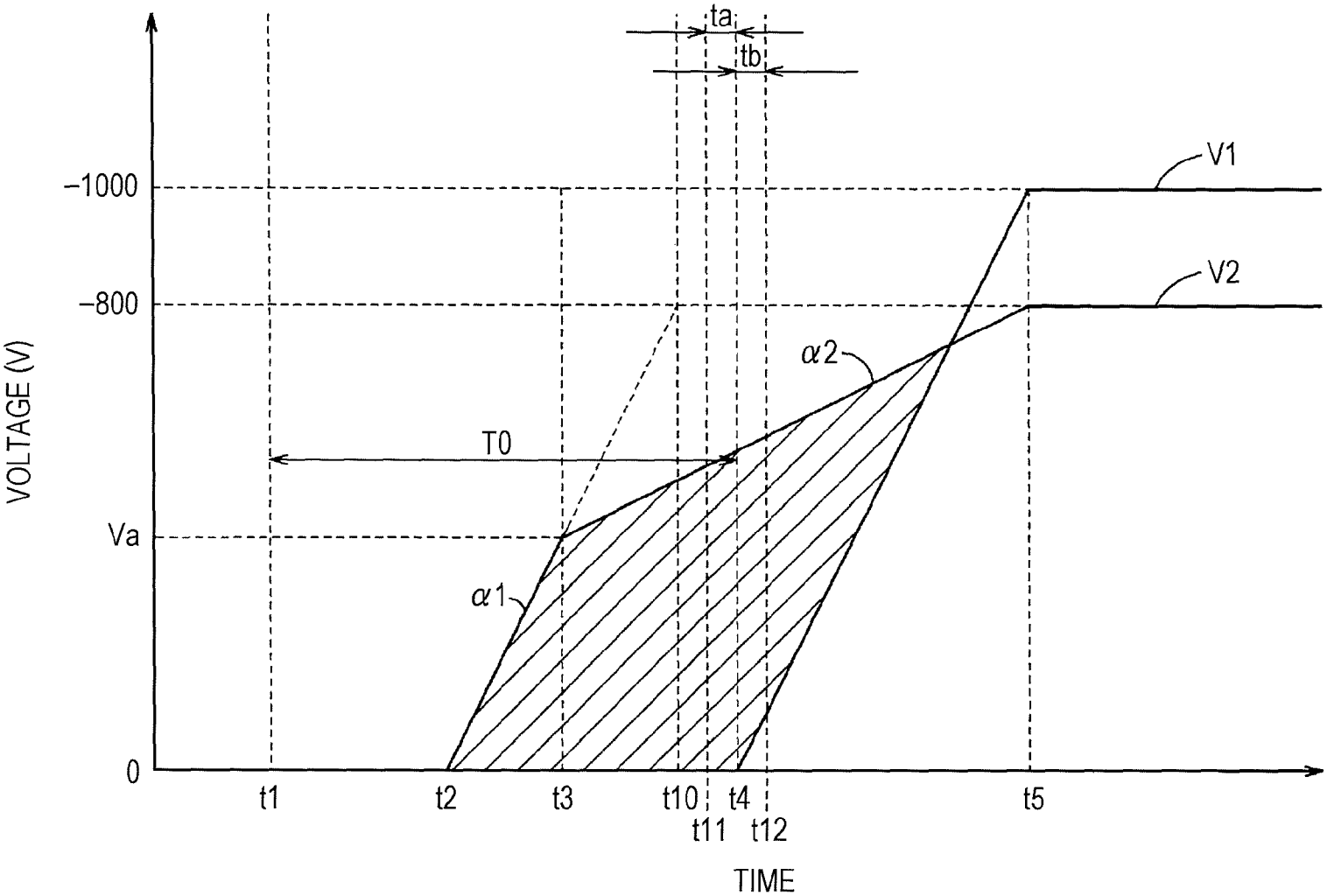
FIG. 4 is a graph showing a change in voltage at a part of the photosensitive drum that the developing roller faces and a change in the developing voltage of the developing roller.
Figure 5:
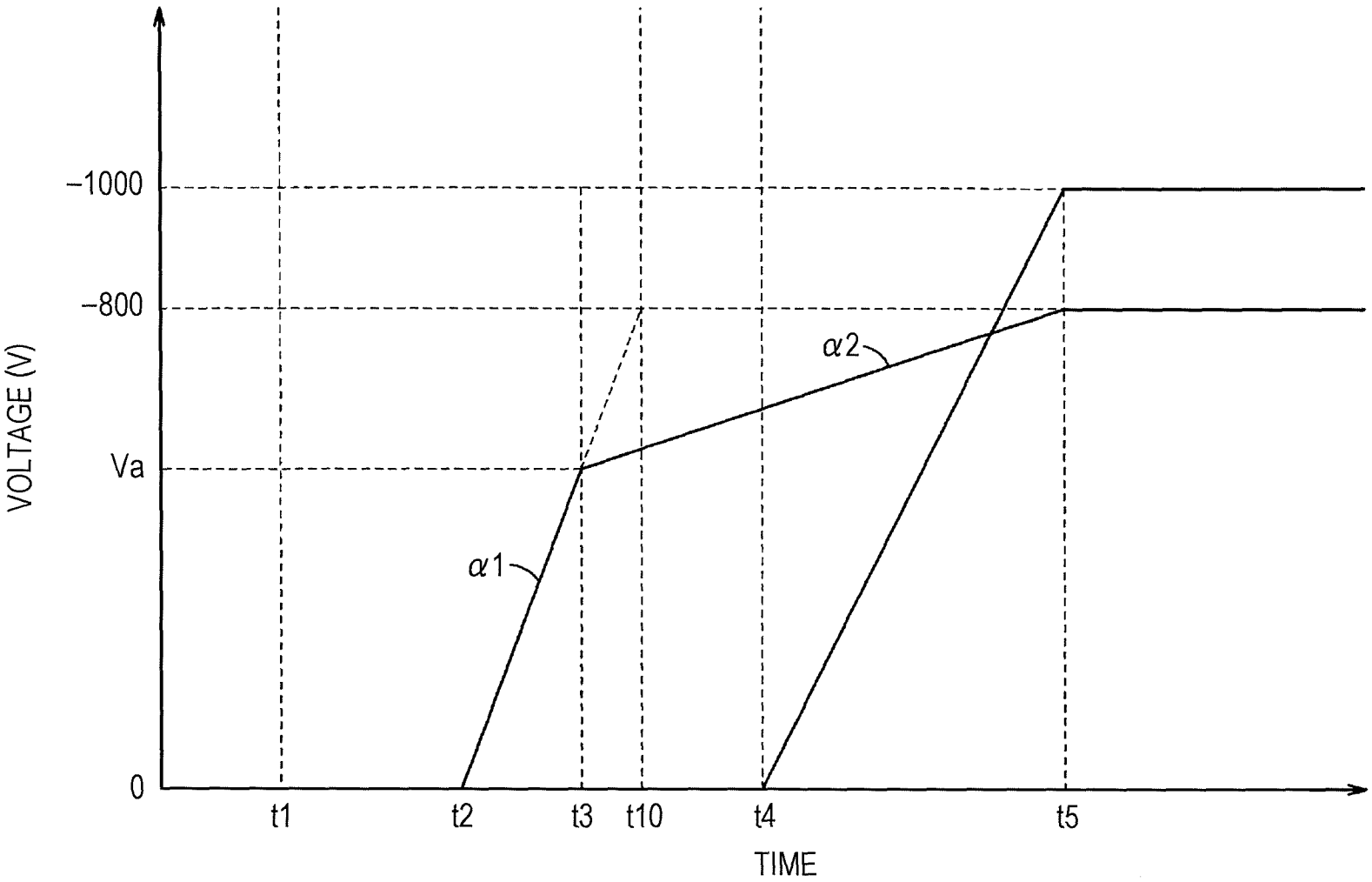
FIG. 5 is a graph showing a change in voltage at the part of the photosensitive drum that the developing roller faces and a change in the developing voltage of the developing roller.

FIG. 3 is a graph showing changes in the charging voltage V1 applied to the photosensitive drum 4K and the developing voltage V2 applied to the developing roller 50K while the voltages are raised. FIGS. 4 and 5 are graphs showing a change in voltage at the part of the photosensitive drum 4K that the developing roller 50K faces and a change in the developing voltage V2 of the developing roller 50K. Note that the change in voltage at the part of the photosensitive drum 4K that the developing roller 50K faces in FIG. 4 is obtained by delaying the change in the charging voltage V1 applied to the photosensitive drum 4K of FIG. 3 by a time T0 required for the photosensitive drum 4K to rotate from the charger 5K to the developing roller 50K. FIGS. 4 and 5 are different from each other in voltage Va and rate α2. In FIGS. 3 to 5, the vertical axis represents voltage and the horizontal axis represents time.

The HV output control unit 102 causes the DC transformer 108K to start application of the charging voltage V1 to the charger 5K at time t1. This starts the change of the charging voltage V1 from 0 V to −1000 V. In this process, the controller 100 rotates the photosensitive drum 4K.

Subsequently, the HV output control unit 102 causes the DC transformer 110K to start application of the developing voltage V2 to the developing roller 50K at time t2 that is a predetermined time T1 after time t1. At this point, the HV output control unit 102 sets the rate α1 at which the absolute value of the developing voltage V2 increases per unit time to a maximum value. The predetermined time T1 is a time set in advance, and is counted with a time by the controller 100, for example.

After causing the DC transformers 108K and 110K to start application of the charging voltage V1 and the developing voltage V2, respectively, the HV output control unit 102 determines whether or not to make the rate α2 at which the absolute value of the developing voltage V2 increases per unit time after time t3 when the charging voltage V1 reached −1000 V lower than the rate α1 at which the absolute value of the developing voltage V2 increases per unit time before time t3 on the basis of the developing voltage V2 (hereinafter referred to as voltage Va) at time t3. The determination will be described below.

As shown in FIG. 4, the time when a part charged by the charger 5K at time t1 when the DC transformer 108K started application of the charging voltage V1 reaches the developing roller 50K as a result of rotation of the photosensitive drum 4K is represented by time t4. First, the HV output control unit 102 calculate time t10 when the developing voltage V2 reaches −800 V if the absolute value of the developing voltage V2 increases at the rate α1 after time t3 on the basis of the voltage Va and the rate α1. Specifically, the HV output control unit 102 calculates time t10 by the following expression (1):

$$t10=t3+(Va-800)/\alpha 1 \quad (1)$$

Subsequently, the HV output control unit 102 determines whether or not time t10 is earlier than time t11 that is earlier than time t4 by a time ta. If time t10 is earlier than time t11, the HV output control unit 102 then makes the rate α2 lower than the rate α1 as shown in FIGS. 3 and 4.

Next, determination of the rate α2 will be described. The HV output control unit 102 determines the rate α2 so that the DC transformer 110K can make the developing voltage V2 change to −800 V at time t5 when the part charged by the charger 5K at time t3 reaches the developing roller 50K as a result of rotation of the photosensitive drum 4K as shown in FIG. 4. The memory 104 thus stores Table 1 indicating associations between multiple voltages Va and multiple rates α2. In Table 1, rates α2 (rates α2-1 to α2-6) at which the DC transformer 110K can make the developing voltage V2 change to −800 V at time t5 when the developing voltage V2 is voltages Va (voltages Va-1 to Va-5) at time t3 are recorded. In Table 1, as the absolute value of the voltage Va becomes larger, the rate α2 is lower.

TABLE 1

| Va | α2 |
|---|---|
| Va < Va − 1 | α2 − 1 |
| Va − 1 ≤ Va < Va − 2 | α2 − 2 |
| Va − 2 ≤ Va < Va − 3 | α2 − 3 |
| Va − 3 ≤ Va < Va − 4 | α2 − 4 |
| Va − 4 ≤ Va < Va − 5 | α2 − 5 |
| Va − 5 ≤ Va | α2 − 6 |

The HV output control unit 102 determines the rate α2 on the basis of the associations in Table 1. Specifically, the HV output control unit 102 selects the rate α2 associated with the voltage Va detected at time t3 from the rates α2-1 to α2-6. The rate α2 is determined through the process as described above. The HV output control unit 102 then raises the developing voltage V2 at the determined rate α2 after time t3. In this manner, when the absolute value of the voltage Va is relatively small, the HV output control unit 102 raises the developing voltage V2 at a relatively high rate α2 as shown in FIG. 4. When the absolute value of the voltage Va is relatively large, the HV output control unit 102 raises the developing voltage V2 at a relatively low rate α2 as shown in FIG. 5.

Figure 6:
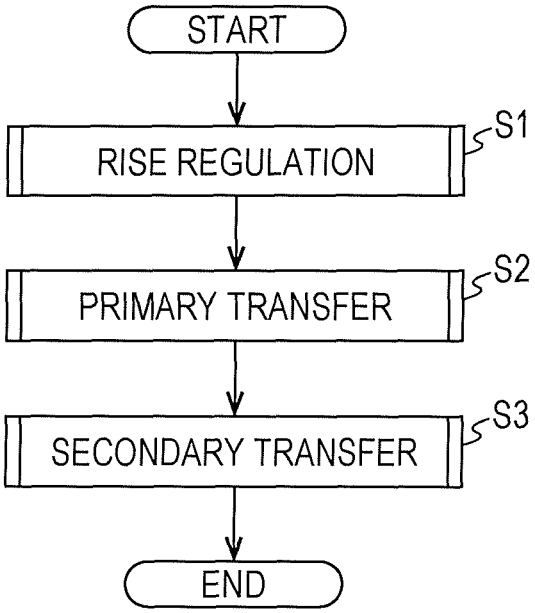
FIG. 6 is a flowchart of operation performed by a HV output control unit.
Figure 7:
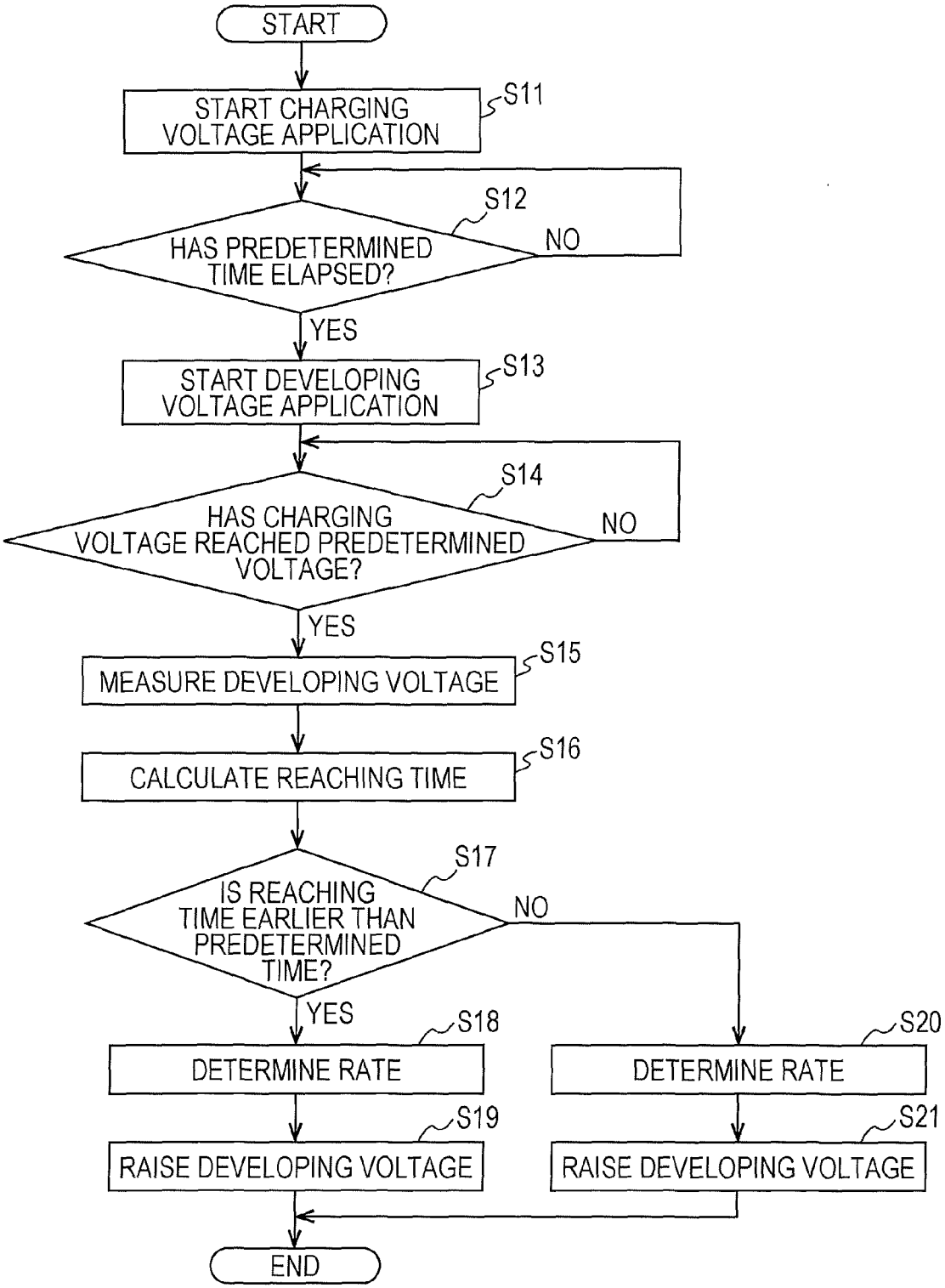
FIG. 7 is a flowchart of a subroutine of step S1 in FIG. 6.
Figure 8:
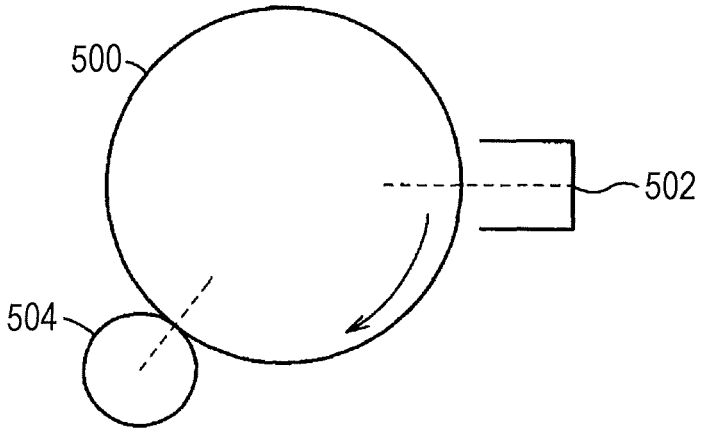
FIG. 8 is a diagram illustrating a photosensitive drum, a charger, and a developing roller.
Figure 9:
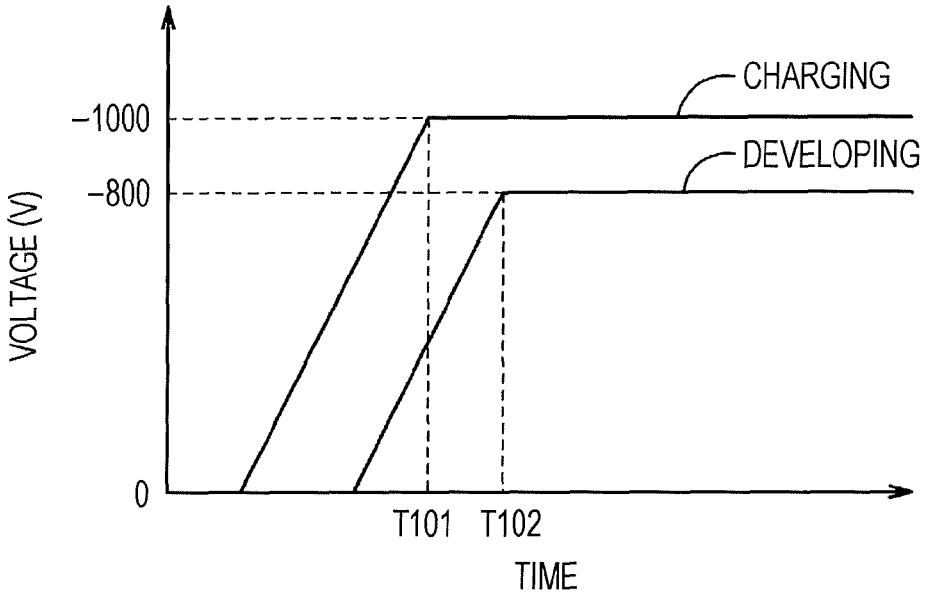
FIG. 9 is a graph showing changes in charging voltage applied to the photosensitive drum and voltage applied to the developing roller while the voltages are raised.
Figure 10:
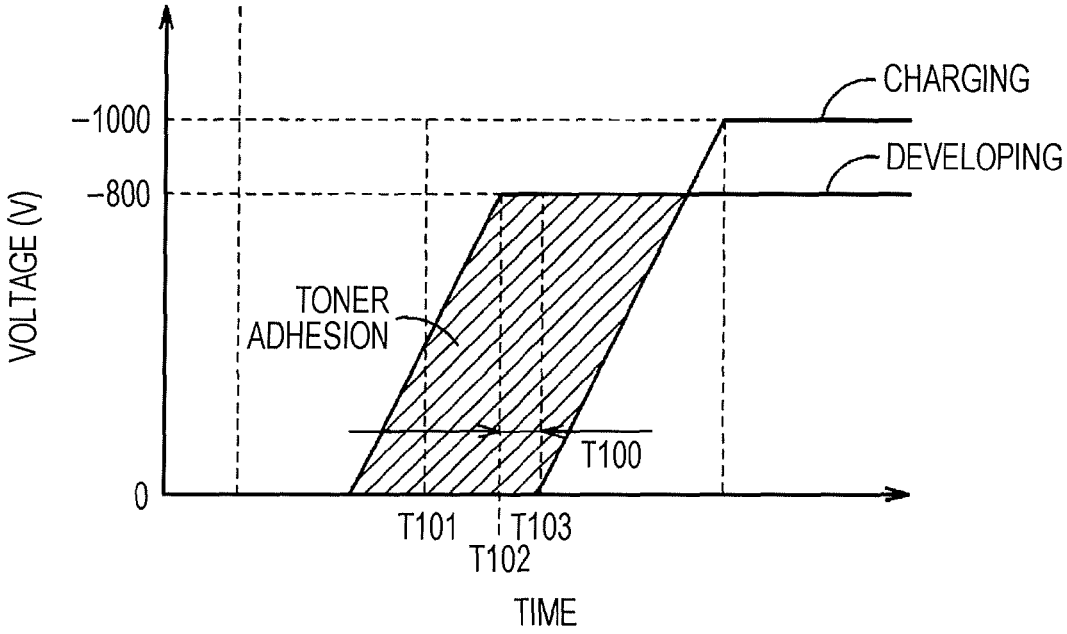
FIG. 10 is a graph showing a change in voltage at a part of the photosensitive drum that the developing roller faces and a change in voltage of the developing roller.

Next, the operation performed by the HV output control unit 102 in raising the charging voltage V1 and the developing voltage V2 will be described with reference to flowcharts. FIG. 6 is a flowchart of the operation performed by the HV output control unit 102. FIG. 7 is a flowchart of a subroutine of step S1 in FIG. 6.

First, the HV output control unit 102 performs rise regulation (step S1). In the rise regulation, the HV output control unit 102 causes the DC transformer 108K to start application of the charging voltage V1 to the charger 5K at time t1 (step S11).

Subsequently, the HV output control unit 102 determines whether or not the predetermined time T1 has elapsed from step S11 (time t1) (step S12). If the predetermined time T1 has elapsed, the process proceeds to step S13. If the predetermined time T1 has not elapsed, the process returns to step S12.

If the predetermined time T1 has elapsed (that is, at time t2), the HV output control unit 102 causes the DC transformer 110K to start application of the developing voltage V2 to the developing roller 50K (step S13).

Subsequently, the HV output control unit 102 determines whether or not the charging voltage V1 has reached −1000V (step S14). If the charging voltage V1 has reached −1000 V, the process proceeds to step S15. If the charging voltage V1 has not reached −1000 V, the process returns to step S14.

If the charging voltage V1 has reached −1000 V, the HV output control unit 102 measures the developing voltage V2 and obtains the voltage Va (step S15). The timing of step S15 is time t3. The HV output control unit 102 further calculates time t10 when the developing voltage V2 reaches −800 V if the absolute value of the developing voltage V2 increases at the rate α1 after time t3 when the charging voltage V1 reached −1000 V on the basis of the voltage Va and the rate α1 (step S16).

Subsequently, the HV output control unit 102 determines whether or not time t10 is earlier than time t11 (step S17). Time t11 is time earlier than time t4 by a time ta, time t4 being the time when the part charged by the charger 5K at the timing when the DC transformer 108K started application of the charging voltage V1 reaches the developing roller 50K as a result of rotation of the photosensitive drum 4K. If time t10 is earlier than time t11, the process proceeds to step S18. If time t10 is not earlier than time t11, the process proceeds to step S20.

If time t10 is earlier than time t11, the HV output control unit 102 determines to make the rate α1 lower than the rate α2, and determines the rate α2 (step S18). In step S18, the HV output control unit 102 determines the rate α2 on the basis of the associations in Table 1. Specifically, the HV output control unit 102 selects the rate α2 associated with the voltage Va detected at time t3 from the rates α2-1 to α2-6. Thereafter, the HV output control unit 102 performs PWM control on the DC transformer 108K so that the developing voltage V2 will rise at the rate α2 (step S19). The HV output control unit 102 sets the duty ratio of a control signal output to the DC transformer 108K to an appropriate value to perform the PWM control. Thereafter, the operation proceeds to step S2 in FIG. 6.

If time t10 is not earlier than time t11, the HV output control unit 102 determines not to make the rate α1 lower than the rate α2, and determines the rate α2 (step S20). In step S20, the HV output control unit 102 determines the rate α2 to be a maximum value. Thereafter, the HV output control unit 102 performs PWM control on the DC transformer 108K so that the developing voltage V2 will rise at the rate α2 (step S21). The HV output control unit 102 sets the duty ratio of a control signal output to the DC transformer 108K to an appropriate value to perform the PWM control. Thereafter, the operation proceeds to step S2 in FIG. 6.

In step S2 described above, the controller 100 primarily transfers the toner image from the photosensitive drum 4K to the intermediate transfer belt 11 (step S2). The controller 100 then secondarily transfers the toner image from the intermediate transfer belt 11 to a sheet (step S3). The process is terminated here.

Advantageous Effects

According to the image forming apparatus 1, while raising the developing voltage V2 of the developing roller 50K and the charging voltage V1 of the charger 5K, wasteful consumption of toner can be prevented or reduced. More specifically, after causing the DC transformers 108K and 110K to start application of the charging voltage V1 and the developing voltage V2, respectively, the HV output control unit 102 determines whether or not to make the rate α2 at which the absolute value of the developing voltage V2 increases per unit time after time t3 when the charging voltage V1 reached −1000 V lower than the rate α1 at which the absolute value of the developing voltage V2 increases per unit time before time t3 on the basis of the developing voltage V2 (hereinafter referred to as voltage Va) at time t3. As a result, the area of a region surrounded by the charging voltage V1 and the developing voltage V2 is smaller when the HV output control unit 102 makes the rate α2 lower than the rate α1 than when the HV output control unit 102 does not make the rate α2 lower than the rate α1 as shown by the hatched region in FIG. 4. The amount of toner wastefully consumed while the charging voltage V1 and the developing voltage V2 are raised is proportional to the area of the region surrounded by the charging voltage V1 and the developing voltage V2. Thus, according to the image forming apparatus 1, while raising the developing voltage V2 of the developing roller 50K and the charging voltage V1 of the charger 5K, wasteful consumption of toner can be prevented or reduced.

Furthermore, according to the image forming apparatus 1, wasteful consumption of toner can also be prevented or reduced for the following reason. More specifically, the HV output control unit 102 determines the rate α2 on the basis of a detected voltage Va and the associations in Table 1. As a result, the HV output control unit 102 can cause the DC transformer 110K to make the developing voltage V2 change to −800 V at time t5 when the part charged by the charger 5K at time t3 reaches the developing roller 50K as a result of rotation of the photosensitive drum 4K as shown in FIG. 4.

Furthermore, according to the image forming apparatus 1, an appropriate rate α2 can be determined. More specifically, wasteful consumption of toner is less likely to occur when the rise of the developing voltage V2 is slow while wasteful consumption of toner is likely to occur when the rise of the developing voltage V2 is fast. The HV output control unit 102 thus determines whether the rise of the developing voltage V2 is fast or slow, that is, whether time t10 is earlier than time t11. As a result, an appropriate rate α2 can be determined.

Other Embodiments

The image forming apparatus according to the present invention is not limited to the image forming apparatus 1 described above, but can be modified within the scope thereof.

Note that the HV output control unit 102 determines whether or not to make the rate α2 after time t3 lower than rate α1 before time t3 on the basis of the developing voltage V2 (hereinafter referred to as voltage Va) at time t3 when the charging voltage V1 reached −1000 V. The HV output control unit 102, however, may make the determination on the basis of the developing voltage V2 at the time when the charging voltage V1 reached a voltage (−800 V, for example) other than −1000 V. If −800 V is used for the determination, movement of toner from the developing roller 50K to the photosensitive drum 4K is prevented or reduced. When a voltage other than −1000 V is used for the determination, however, the HV output control unit 102 needs to determine time t10 in view of the time required for the charging voltage V1 to change from the voltage other than −1000 V to −1000 V. The time required for the charging voltage V1 to change from the voltage other than −1000 V to −1000 V, however, may vary. It is therefore preferable to use −1000 V for the determination.

Note that the HV output control unit 102 makes the rate α2 lower than the rate α1 when time t10 is earlier than time t11 that is the time earlier than time t4 by a time to as shown in FIGS. 3 and 4. The HV output control unit 102, however, may determine whether or not to make the rate α2 lower than the rate α1 under another condition. The HV output control unit 102 only needs to determine whether or not to make the rate α2 lower than the rate α1 on the basis of the voltage Va of the developing voltage V2 at time t3. For example, the HV output control unit 102 may determine to make the rate α2 lower than the rate α1 when the voltage Va of the developing voltage V2 at time t3 is greater than a predetermined voltage.

While toner is negatively charged and the charging voltage V1 and the developing voltage V2 are negative voltages, alternatively, toner may be positively charged and the charging voltage V1 and the developing voltage V2 may be positive voltages.

While the HV output control unit 102 sets the duty ratio of a control signal output to the DC transformer 108K to an appropriate value to perform the PWM control, an analog value of the developing voltage V2 may alternatively be controlled.

A charging voltage V1 of −1000 V and a developing voltage V2 of −800 V are only examples, and other values may be used.

When time t10 is earlier than time t11, the HV output control unit 102 makes the rate α2 lower than the rate α1 as shown in FIGS. 3 and 4. The HV output control unit 102, however, may determine whether or not to make the rate α2 lower than the rate α1 according to a rise condition of the charging voltage V1 in addition to the rise condition of the developing voltage V2.

As shown in FIG. 4, the time when a part charged by the charger 5K at time t3 reaches the developing roller 50K as a result of rotation of the photosensitive drum 4K is represented by time t5. The HV output control unit 102 calculates time t5 by the following expression (2):

$$t5=t3+T0 \quad (2)$$

Subsequently, the HV output control unit 102 determines whether or not time t10 is earlier than time t11 that is earlier than time t4 by a time ta, and determines whether or not time t5 is earlier than time t12 that is later than time t4 by a time tb. If time t10 is earlier than time t11 and if time t5 is later than time t12, the HV output control unit 102 then makes the rate α2 lower than the rate α1 as shown in FIGS. 3 and 4.

Thus, wasteful consumption of toner is less likely to occur when the rise of the charging voltage V1 is fast while wasteful consumption of toner is likely to occur when the rise of the charging voltage V1 is slow. The HV output control unit 102 thus determines whether the rise of the charging voltage V1 is fast or slow, that is, whether time t5 is later than time t12. As a result, the rate α2 can be appropriately determined.

Embodiments of the present invention are useful for image forming apparatuses, and are in particular excellent in being capable of prevent or reduce wasteful consumption of toner while the voltage of the developing roller and the voltage of the charger are raised.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming apparatus comprising:

a photosensitive member rotated in a predetermined direction;

a charging unit configured to charge a circumferential surface of the photosensitive member;

a developing unit carrying a developer including toner and carriers, and including a developer bearing member configured to apply toner charged in a first polarity to the circumferential surface of the photosensitive member;

a first voltage applying unit configured to apply a first voltage of the first polarity to the charging unit;

a second voltage applying unit configured to apply a second voltage of the first polarity to the developer bearing member;

a first voltage detecting unit configured to detect the first voltage;

a second voltage detecting unit configured to detect the second voltage; and a controller, wherein the controller determines whether or not to make a second rate lower than a first rate according to the second voltage at a first timing when the first voltage reaches a first predetermined voltage after causing the first voltage applying unit and the second voltage applying unit to start application of the first voltage and the second voltage, respectively, the second rate being a non-zero rate at which an absolute value of the second voltage increases per unit time after the first timing, the first rate being a non-zero rate at which an absolute value of the second voltage increases per unit time before the first timing.

2. The image forming apparatus according to claim 1, wherein the first predetermined voltage is the first voltage applied to the charging unit by the first voltage applying unit while an electrostatic latent image formed on the circumferential surface of the photosensitive member is developed.

3. The image forming apparatus according to claim 1, wherein a timing when a part of a surface of the photosensitive member charged by the charging unit at a timing when the first voltage applying unit started application of the first voltage reaches the developer bearing member as a result of rotation of the photosensitive member is a second timing, a timing when the second voltage reaches a second predetermined voltage having an absolute value smaller than that of the first predetermined voltage when an absolute value of the second voltage increases at the first rate after the first timing is a third timing, and the controller makes the second rate lower than the first rate when the third timing is earlier than a fourth timing that is earlier by a first time than the second timing.

4. The image forming apparatus according to claim 1, wherein a timing when a part of a surface of the photosensitive member charged by the charging unit at a timing when the first voltage applying unit started application of the first voltage reaches the developer bearing member as a result of rotation of the photosensitive member is a second timing, a timing when a part of a surface of the photosensitive member charged by the charging unit at the first timing reaches the developer bearing member as a result of rotation of the photosensitive member is a fourth timing, and the controller makes the second rate lower than the first rate when the fourth timing is later than a fifth timing that is later than the second timing by a second time.

5. The image forming apparatus according to claim 1, wherein a timing when a part of a surface of the photosensitive member charged by the charging unit at the first timing reaches the developer bearing member as a result of rotation of the photosensitive member is a fourth timing, and the controller determines the second rate so as to cause the second voltage applying unit to change the second voltage to a second predetermined voltage having an absolute value smaller than that of the first predetermined voltage at the fourth timing.

6. The image forming apparatus according to claim 1, further comprising a storage unit storing association between the second voltage at the first timing and the second rate, wherein the controller determines the second rate according to the association.

* * * * *